US006485350B1

(12) United States Patent
Giglio

(10) Patent No.: US 6,485,350 B1
(45) Date of Patent: Nov. 26, 2002

(54) ANIMATED HOLIDAY-SCENE DISPLAY DEVICE

(76) Inventor: Agnes Giglio, 72 James St., Franklin Square, NY (US) 11010

( * ) Notice: Subject to any disclaimer, the term of this patent is extended or adjusted under 35 U.S.C. 154(b) by 0 days.

(21) Appl. No.: 09/967,668

(22) Filed: Sep. 29, 2001

(51) Int. Cl.[7] ..... A63H 3/00

(52) U.S. Cl. ..... 446/268; 446/330; 446/353; 446/365; 446/367; 446/83; 446/303; 40/419; 40/414; 40/442; 40/415; 40/431; 40/429; 40/427

(58) Field of Search ..... 446/268, 136, 446/272, 292, 293, 353, 362, 365, 366, 367, 390; 40/409, 410, 411, 414, 418, 419, 421, 423, 429, 431, 443, 444, 441, 442

(56) References Cited

U.S. PATENT DOCUMENTS

D61,022 S * 5/1922 Sharp
1,740,747 A * 12/1929 Price ..... 40/441
2,633,669 A * 4/1953 Churus ..... 446/353
2,975,533 A * 3/1961 Burns, Jr.
4,068,403 A * 1/1978 Weiser ..... 446/138
4,775,352 A * 10/1988 Curran et al.
5,468,172 A * 11/1995 Basile
5,603,993 A * 2/1997 Ampomah
5,607,336 A * 3/1997 Lebensfeld et al.
5,820,441 A * 10/1998 Pracas
6,312,141 B1 * 11/2001 Liu

FOREIGN PATENT DOCUMENTS

GB 2230468 * 10/1990

* cited by examiner

*Primary Examiner*—Derris H. Banks
*Assistant Examiner*—Ali Abdelwahed

(57) ABSTRACT

An animated holiday-scene display device for providing decorative entertainment tools. The animated holiday-scene display device includes a base member having a top side and being adapted to rest upon a surface; and also includes an ornamental figurine being mounted upon the topside of the base member and having a body and movable arms; and further includes an ornamental object also being mounted upon the top side of the base member; and also includes a light-emitting assembly being disposed throughout the ornamental object; and further includes an assembly for actuating movement of the ornamental figurine.

6 Claims, 3 Drawing Sheets

ANIMATED HOLIDAY-SCENE DISPLAY DEVICE

BACKGROUND OF THE INVENTION

1. Field of the Invention

The present invention relates to holiday events entertaining assemblies and more particularly pertains to a new animated holiday-scene display device for providing decorative entertainment tools.

2. Description of the Prior Art

The use of holiday events entertaining assemblies is known in the prior art. More specifically, holiday events entertaining assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,775,352; 5,468,172; U.S. Pat. No. Des. 61,022; U.S. Pat. Nos. 5,607,336; 5,820,441; and 5,603,993.

While these devices fulfill their respective, particular objectives and requirements, the aforementioned patents do not disclose a new animated holiday-scene display device. The inventive device includes a base member having a top side and being adapted to rest upon a surface; and also includes an ornamental figurine being mounted upon the topside of the base member and having a body and movable arms; and further includes an ornamental object also being mounted upon the top side of the base member; and also includes a light-emitting assembly being disposed throughout the ornamental object; and further includes an assembly for actuating movement of the ornamental figurine; and allows the user to display the animated holiday-scene display device, in particular, during the holidays to add to the gala of the particular event.

In these respects, the animated holiday-scene display device according to the present invention substantially departs from the conventional concepts and designs of the prior art, and in so doing provides an apparatus primarily developed for the purpose of providing decorative entertainment tools.

SUMMARY OF THE INVENTION

The general purpose of the present invention, which will be described subsequently in greater detail, is to provide a new animated holiday-scene display device apparatus and method which has many of the advantages of the holiday events entertaining assemblies mentioned heretofore and many novel features that result in a new animated holiday-scene display device which is not anticipated, rendered obvious, suggested, or even implied by any of the prior art holiday events entertaining assemblies, either alone or in any combination thereof.

There has thus been outlined, rather broadly, the more important features of the animated holiday-scene display device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new animated holiday-scene display device apparatus and method which has many of the advantages of the holiday events entertaining assemblies mentioned heretofore and many novel features that result in a new animated holiday-scene display device which is not anticipated, rendered obvious, suggested, or even implied by any of the prior art holiday events entertaining assemblies, either alone or in any combination thereof.

Still another object of the present invention is to provide a new animated holiday-scene display device for providing decorative entertainment tools.

Still yet another object of the present invention is to provide a new animated holiday-scene display device that livens and induces a gala or party atmosphere.

Even still another object of the present invention is to provide a new animated holiday-scene display device that adds decorative appeal during the holiday season.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
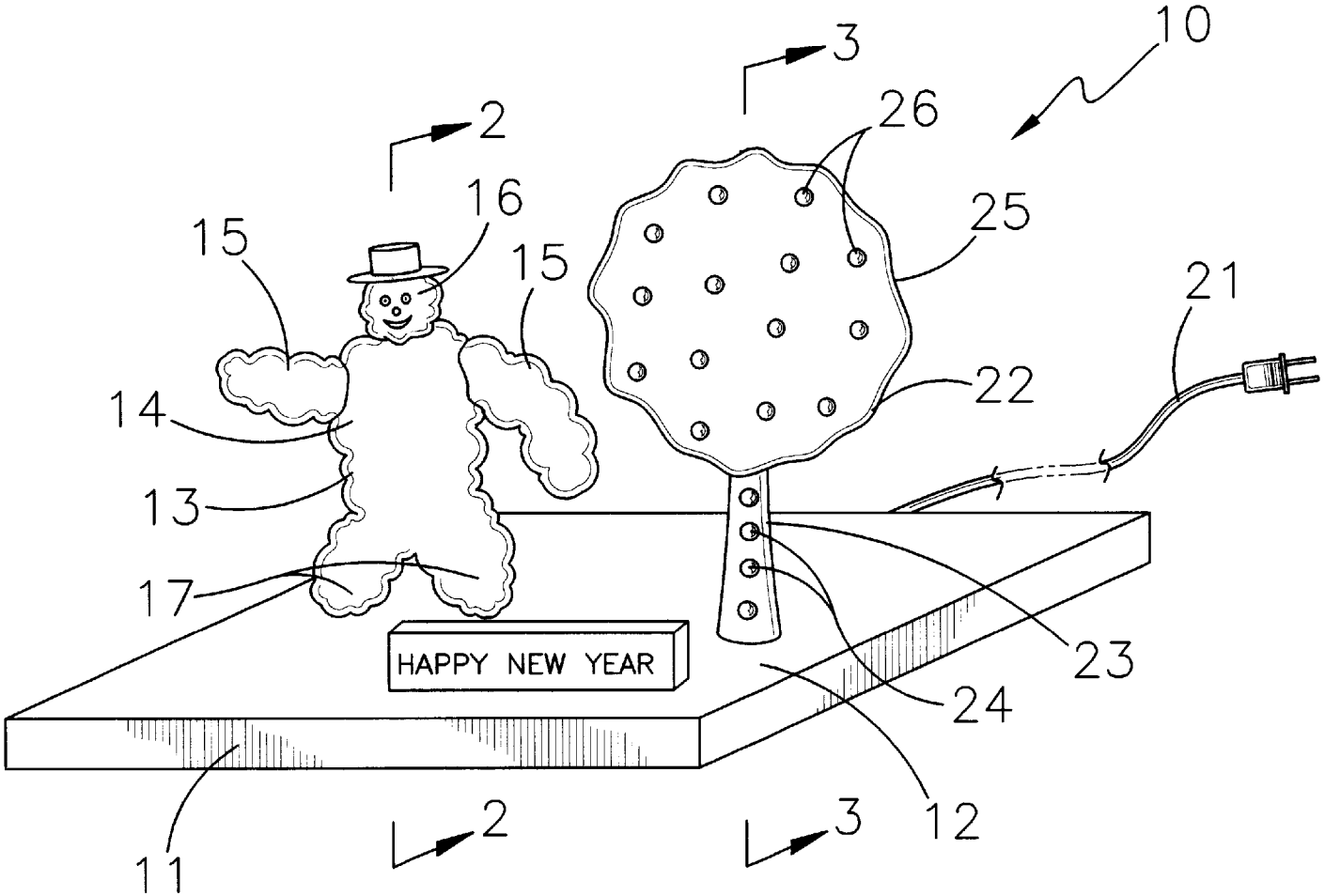
FIG. 1 is a perspective view of a new animated holiday-scene display device according to the present invention and shown in use.
Figure 2:
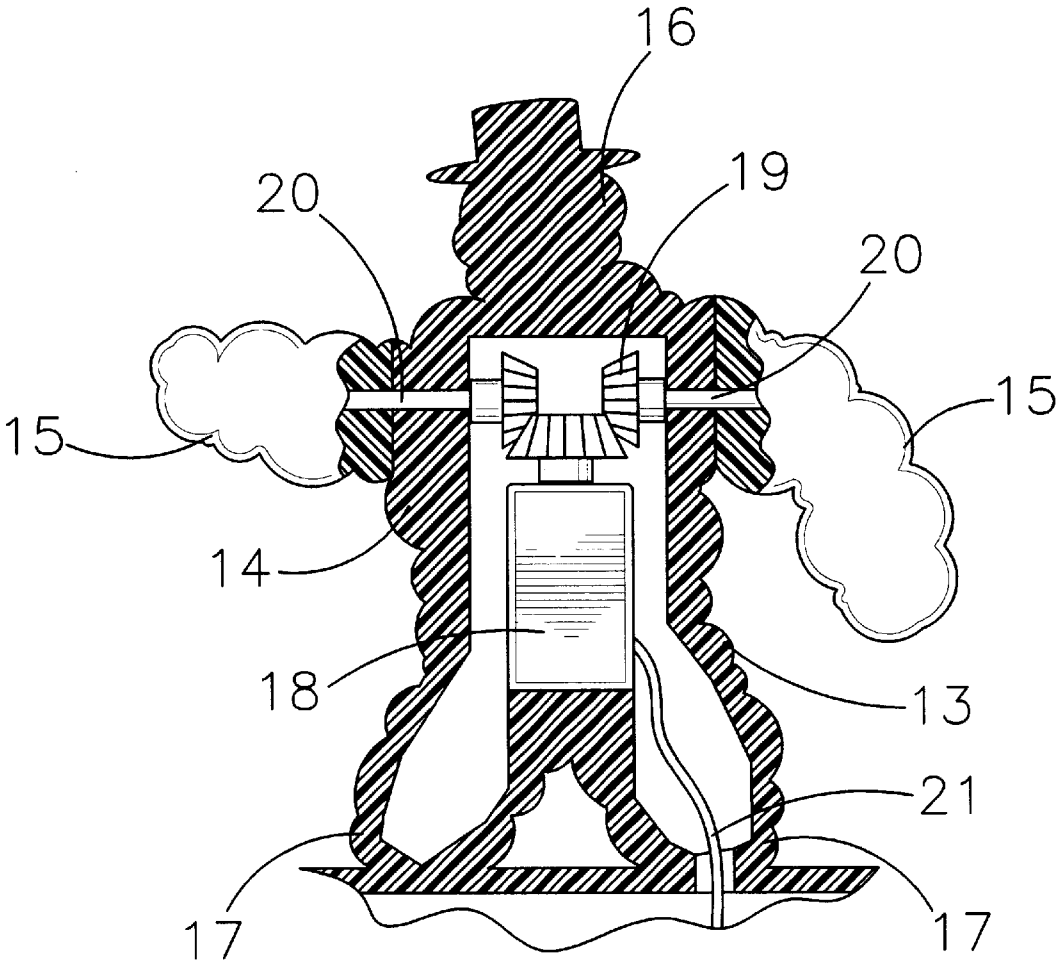
FIG. 2 is a cross-sectional view of an ornamental figurine of the present invention.
Figure 3:
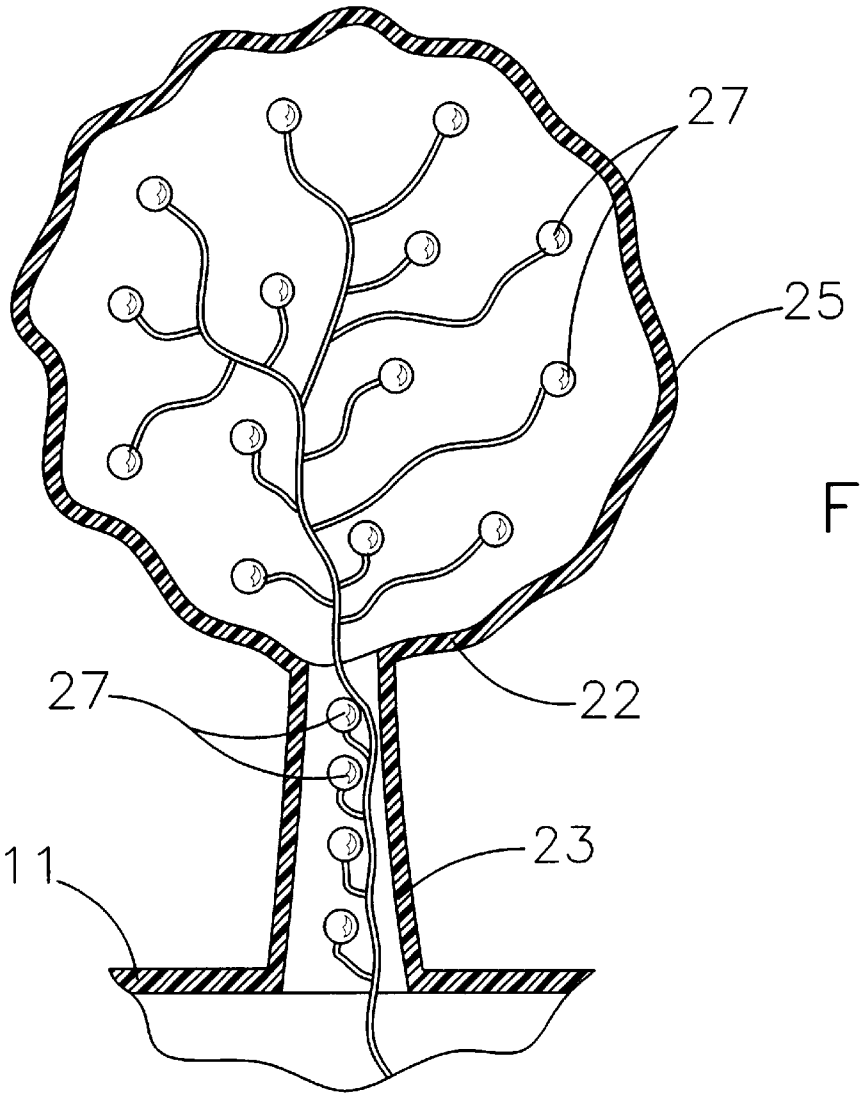
FIG. 3 is a cross-sectional view of an ornamental object of the present invention.

With reference now to the drawings, and in particular to FIGS. 1 through 3 thereof, a new animated holiday-scene display device embodying the principles and concepts of the present invention and generally designated by the reference numeral 10 will be described.

As best illustrated in FIGS. 1 through 3, the animated holiday-scene display device 10 generally comprises a base member 11 having a top side 12 and being adapted to rest upon a surface. The base member 11 is generally a board.

An ornamental figurine 13 is conventionally and securely mounted upon the top side 12 of the base member 11 and has a body 14 and movable arms 15. The ornamental figurine 13 is shaped like that of either a Baby New Year character having a ribbon-like member wrapped about the body 14 thereof, or a snowman. The ornamental figurine 13 also has a head 16 and legs 17 which are securely and conventionally attached to the base member 11 with the ornamental figurine 13 being erected upon the top side 12 of the base member 11. The movable arms 15 of the ornamental figurine 13 extend from the body 14 and are made of a flexible material.

An ornamental object 22 also is conventionally and securely mounted upon the top side 12 of the base member 11. The ornamental object 22 includes a pole 23 being vertically-mounted upon the top side 12 of the base member 11, and further includes a ball-shaped member 25 being movably and conventionally mounted to the pole 23. The pole 23 has a plurality of openings 24 being spacedly disposed through a wall of the pole 23, and the ball-shaped member 25 has a plurality of holes 26 being spacedly disposed through a wall thereof.

A light-emitting assembly is conventionally disposed throughout the ornamental object 22. The light-emitting assembly includes a plurality of light-emitting members 27 being conventionally disposed in the pole 23 and the ball-shaped member 25 for emitting light through the openings 24 and the holes 26, and also includes a means for energizing the light-emitting members 27. The means for energizing the light-emitting members 27 includes a power cord 21. Means for actuating movement of the ornamental figurine 13 includes a motor 18 being securely and conventionally disposed in the body 14 of the ornamental figurine 13, and also includes a plurality of gear members 19 being actuated by the motor, and further includes a plurality of shaft members 20 being conventionally connected to the gear members 19 and being extended in the movable arms 15 for the movement thereof, and also includes a means for energizing the motor 18. The means for energizing the motor 18 includes the power cord 21 being conventionally connected to the motor 18 and being connectable to a power source.

In use, the user places the base member 11 upon a suitable flat surface and plugs the power cord 21 into an electrical outlet; whereupon the light-emitting members 27 are energized, and the motor 18 is energized which causes the arms 15 to move thereabout as if the ornamental figurine 13 is dancing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the animated holiday-scene display device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An animated holiday-scene display device comprising:

a base member having a top side and being adapted to rest upon a surface;

an ornamental figurine being mounted upon said topside of said base member and having a body and movable arms, said ornamental figurine also having a head and legs which are securely attached to said base member with said ornamental figurine being erected upon said top side of said base member;

an ornamental object also being mounted upon said top side of said base member;

a light-emitting assembly being disposed throughout said ornamental object; and means for actuating movement of said ornamental figurine, said movable arms of said ornamental figurine extending from said body and being made of a flexible material, said means for actuating movement of said ornamental figurine including a motor being securely disposed in said body of said ornamental figurine, and also including a plurality of gear members being actuated by said motor, and further including a plurality of shaft members being connected to said gear members and being extended in said movable arms for the movement thereof, and also including a means for energizing said motor.

2. An animated holiday-scene display device as described in claim 1, wherein said means for energizing said motor includes a power cord being connected to said motor and being connectable to a power source.

3. An animated holiday-scene display device as described in claim 2, wherein said ornamental object includes a pole being vertically-mounted upon said top side of said base member, and further includes a ball-shaped member being movably mounted to said pole.

4. An animated holiday-scene display device as described in claim 3, wherein said pole has a plurality of openings spacedly disposed through a wall of said pole, and said ball-shaped member has a plurality of holes spacedly disposed through a wall thereof.

5. An animated holiday-scene display device as described in claim 4, wherein said light-emitting assembly includes a plurality of light-emitting members being disposed in said pole and said ball-shaped member for emitting light through said openings and said holes, and also includes a means for energizing said light-emitting members.

6. An animated holiday-scene display device as described in claim 5, wherein said means for energizing said light-emitting members includes said power cord.

* * * * *